US009128445B2

(12) United States Patent
Osada

(10) Patent No.: US 9,128,445 B2
(45) Date of Patent: Sep. 8, 2015

(54) PRINTING APPARATUS, METHOD FOR CONTROLLING PRINTING APPARATUS, AND STORAGE MEDIUM

(71) Applicant: CANON KABUSHIKI KAISHA, Tokyo (JP)

(72) Inventor: Tomoaki Osada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/283,102

(22) Filed: May 20, 2014

(65) Prior Publication Data

US 2014/0348519 A1 Nov. 27, 2014

(30) Foreign Application Priority Data

May 24, 2013 (JP) ..... 2013-109649

(51) Int. Cl.
*B65H 3/44* (2006.01)
*G03G 15/00* (2006.01)
*B65H 7/00* (2006.01)

(52) U.S. Cl.
CPC ..... *G03G 15/6508* (2013.01); *B65H 3/44* (2013.01); *B65H 3/446* (2013.01); *B65H 7/00* (2013.01)

(58) Field of Classification Search
CPC ..... B65H 7/00; B65H 3/44; B65H 3/446; B65H 2405/33; G03G 15/6508
See application file for complete search history.

(56) References Cited

U.S. PATENT DOCUMENTS

2008/0084020 A1* 4/2008 Nakamura ..... 270/1.01

FOREIGN PATENT DOCUMENTS

JP S63-121868 A 5/1988

* cited by examiner

*Primary Examiner* — Howard Sanders
(74) *Attorney, Agent, or Firm* — Canon USA, Inc., IP Division

(57) ABSTRACT

In a printing apparatus, registration of a particular type of sheet in a particular sheet storage unit can prevent reduction in convenience. A printing apparatus configured to feed a sheet from any one of a plurality of sheet storage units includes a setting unit configured to set a sheet storage unit included in the plurality of sheet storage units as a particular sheet storage unit to be used when a sheet storage unit to be used for a job has not been specified, a specifying unit configured to specify a type of sheet to be stored in a sheet storage unit included in the plurality of sheet storage units, and a control unit configured to perform control so that the specifying unit does not specify a particular type in the sheet storage unit set by the setting unit.

13 Claims, 14 Drawing Sheets

FIG. 6B

| |
|---|
| THICK PAPER |
| OHP FILM |
| ENVELOPE |
| PREPRINT PAPER |
| INTERMEDIATE PAPER |
| TAB PAPER |

PRINTING APPARATUS, METHOD FOR CONTROLLING PRINTING APPARATUS, AND STORAGE MEDIUM

BACKGROUND

1. Field

The present disclosure relates to a printing apparatus, a method for controlling a printing apparatus, and a storage medium.

2. Description of the Related Art

In recent years, in a copy function performed by a printing apparatus having a scanner function, an automatic paper selection (APS) function is used. Based on the size of a document detected by a scanner apparatus, the APS function automatically selects an optimal cassette and outputs a record (see Japanese Patent Application Laid-Open No. 63-121868, for example). Further, even if the size of a document can be automatically detected, it is also possible to manually select a cassette for feeding a sheet, by a user operation through an operation unit.

On the other hand, there is also a printing apparatus without a document size detection function in a scanner apparatus in order to reduce the cost of the apparatus or reduce the size of the apparatus. Such a printing apparatus cannot use the APS function. Thus, a user always needs to select a sheet feeding cassette when a copy job is executed. In this case, the user needs to select a sheet feeding cassette every time a copy job is executed, which is cumbersome to the user. Thus, a conventional printing apparatus employs a method for selecting a particular sheet feeding cassette as a default sheet feeding cassette.

The method for selecting a particular sheet feeding cassette as a default sheet feeding cassette, however, may present issues. If special paper such as thick paper is set in the sheet feeding cassette selected as the default sheet feeding cassette, there are limitations on the functions that can be used. For example, with thick paper, a user cannot use two-sided printing and a stapling function.

Further, if paper used for a particular purpose, such as preprint paper or an envelope, is set in the sheet feeding cassette selected as the default sheet feeding cassette, the user may unintentionally use the special paper for normal copy.

Moreover, if the sheet feeding cassette selected by default has become unable to be used due to paper out or a failure, the user needs to select another sheet feeding cassette every time a copy job is executed, which is cumbersome.

SUMMARY OF THE INVENTION

According to an aspect of the present invention, a printing apparatus configured to feed a sheet from any one of a plurality of sheet storage units includes a setting unit configured to set a sheet storage unit included in the plurality of sheet storage units as a particular sheet storage unit to be used when a sheet storage unit to be used for a job has not been specified, a specifying unit configured to specify a type of sheet to be stored in a sheet storage unit included in the plurality of sheet storage units, and a control unit configured to perform control so that the specifying unit does not specify a particular type in the sheet storage unit set by the setting unit.

Further features of the present disclosure will become apparent from the following description of exemplary embodiments with reference to the attached drawings.

BRIEF DESCRIPTION OF THE DRAWINGS

FIGS. 6A and 6B are a flow chart illustrating a method for controlling a printing apparatus and a table to be referenced.

DESCRIPTION OF THE EMBODIMENTS

Various exemplary embodiments will be described in detail below with reference to the drawings.

Description of System Configuration

Figure 1:
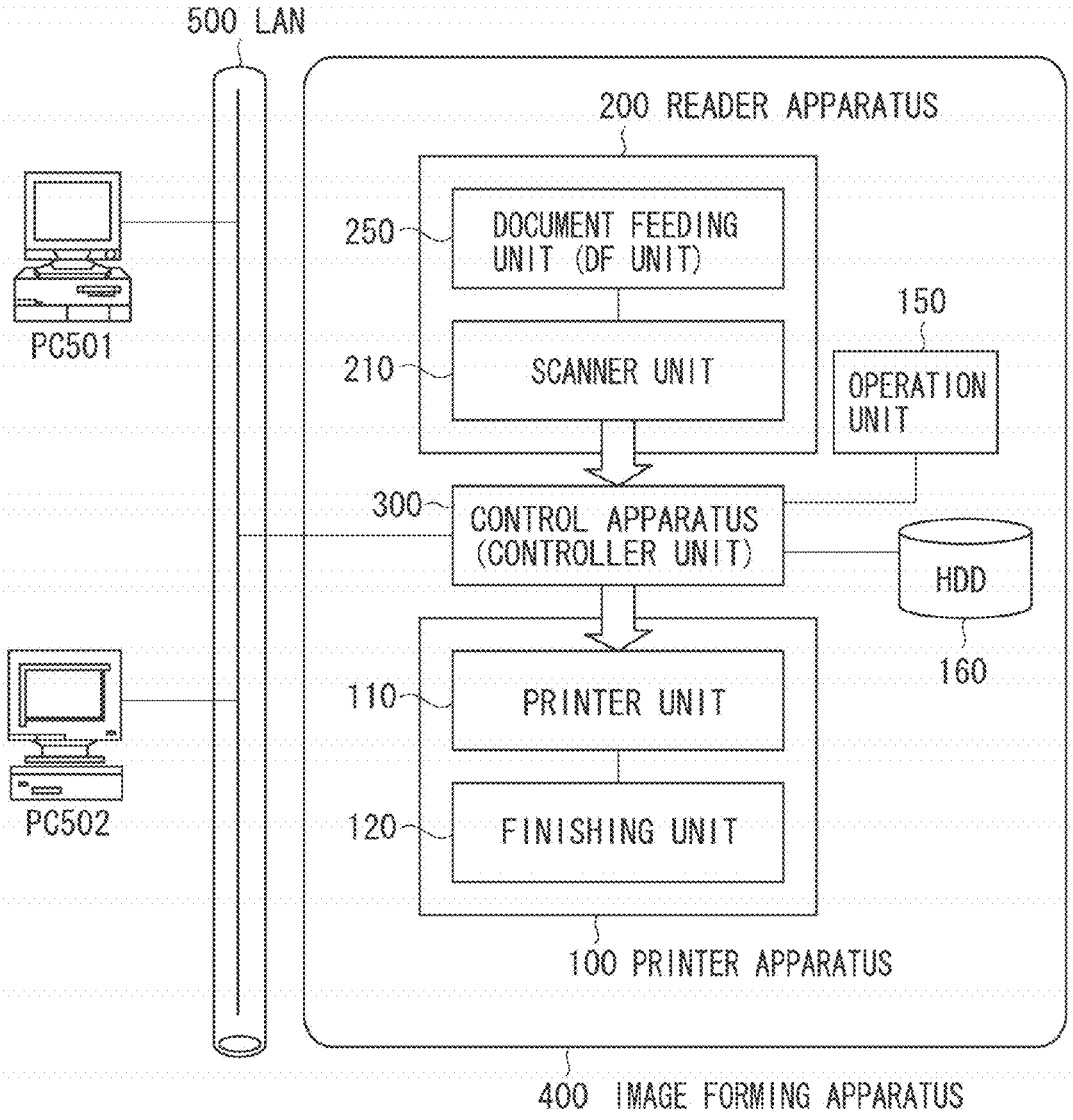
FIG. 1 is a diagram illustrating an example of a printing system including an image forming apparatus and information processing apparatuses.

FIG. 1 is a diagram illustrating an example of a printing system including an image forming apparatus, which has a printing apparatus according to the present exemplary embodiment and a scanner apparatus, and information processing apparatuses. In this example, an image forming apparatus 400 executes, via a local area network (LAN) 500, various jobs including a print job requested by information processing apparatuses (also referred to as "personal computers (PCs)" or "host computers") 501 and 502.

In FIG. 1, the image forming apparatus 400 is connected to the information processing apparatuses 501 and 502 via the LAN 500 such as Ethernet (registered trademark).

The image forming apparatus 400 includes a reader apparatus 200, which performs reading processing of image data, and a printer apparatus 100, which performs printing processing of the image data. Further, the image forming apparatus 400 includes an operation unit 150, which has a keyboard for performing input and output operations and a liquid crystal panel for displaying and setting image data and various functions. Further, the image forming apparatus 400 includes a hard disk drive (HDD) 160, which can store and save image data read by controlling the reader apparatus 200 and image data generated from code data received from the information processing apparatuses 501 and 502 via the LAN 500. The image forming apparatus 400 also includes a control apparatus (controller unit) 300, which controls these components.

The reader apparatus (scanner apparatus) 200 includes a document feeding unit (DF) 250, which conveys a document sheet, and a scanner unit 210, which optically reads a document image and converts the document image into image data as an electric signal. The printer apparatus 100 includes a printer unit 110, which includes sheet feeding cassettes for storing print sheets and a unit for transferring and fixing image data onto a print sheet, and a finishing unit 120, which performs a sorting process and a stapling process on a recording sheet on which printing has been performed.

Figure 2:
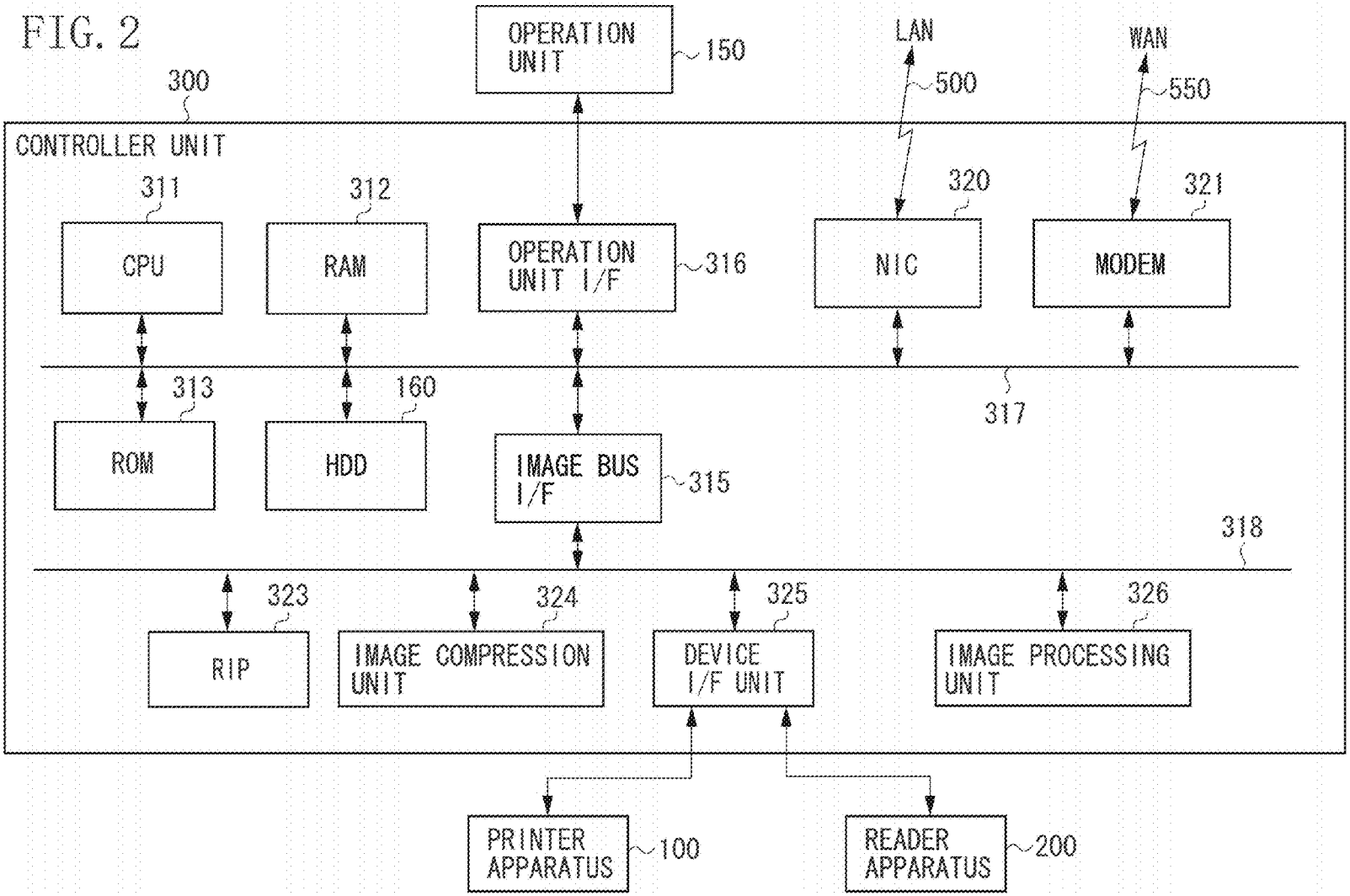
FIG. 2 is a block diagram illustrating details of a control apparatus.

FIG. 2 is a block diagram illustrating details of the control apparatus (controller unit) 300 illustrated in FIG. 1.

In FIG. 2, the controller unit 300 includes an HDD 160, which can store data of a plurality of jobs in the image forming apparatus 400, a central processing unit (CPU) 311, a random-access memory (RAM) (main storage device) 312, and a read-only memory (ROM) 313. The CPU 311 sequentially loads programs stored in the ROM 313 or the HDD 160 into the RAM 312 and executes the programs, thereby achieving functions described below. Further, the controller unit 300 is connected to the reader apparatus 200, which performs the process of reading image data, and the printer apparatus 100, which performs the process of outputting image data, and at the same time, the controller unit 300 is connected to the LAN 500 or a public line (wide area network (WAN)) 550, thereby inputting and outputting code data, image data, and device information.

The CPU 311 performs overall control of the image forming apparatus 400. The RAM 312 is a system work memory for the operation of the CPU 311 and is also an image memory for temporarily storing image data. The ROM 313 functions as a boot ROM and stores a boot program for the system. The HDD 160 can store system software and image data.

An operation unit interface (I/F) 316 functions as an interface unit with the operation unit 150 and outputs, to the operation unit 150, image data to be displayed on the operation unit 150. Further, the operation unit I/F 316 has the function of transmitting, to the CPU 311, information input by a user of the system through the operation unit 150. A network interface card (NIC) 320 is connected to the LAN 500, and controls the transmission and reception of image data and apparatus information via the LAN 500. A modem 321 is connected to the public line (WAN) 550, and controls the transmission and reception of image data and apparatus information via the public line 550. These devices are placed on a system bus 317. An image bus I/F 315 is a bus bridge for connecting the system bus 317 to an image bus 318, which transfers image data at high speed, and converting the data structure.

The image bus 318 includes a Peripheral Component Interconnect (PCI) bus or an Institute of Electrical and Electronics Engineers (IEEE) 1394 bus. A raster image processor (RIP) 323 rasterizes a page description language (PDL) code into a bitmap image. An image compression unit 324 performs a Joint Photographic Experts Group (JPEG) compression/decompression process on multi-valued image data, and performs a Joint Bi-level Image Experts Group (JBIG), Modified Modified READ (MMR), or Modified Huffman (MH) compression/decompression process on binary image data. A device I/F unit 325 is connected to the reader apparatus 200, which is an image input apparatus, the printer apparatus 100, which is an image output apparatus, and the controller unit 300. The device I/F unit 325 performs synchronous-to-asynchronous or asynchronous-to-synchronous conversion of image data. An image processing unit 326 corrects, processes, and edits input image data. These devices are placed on the image bus 318.

The image forming apparatus 400 as described above, for example, executes a copy job by controlling the reader apparatus 200 to read image data of a document, storing the read image data in the HDD 160, and outputting an image onto a recording sheet based on the image data stored in the HDD 160. Further, the image forming apparatus 400 executes a scanner job including storing, in the HDD 160, image data read from the reader apparatus 200, converting the image data into code data, and transmitting the code data to the information processing apparatuses (PCs) 501 and 502 via the LAN 500. Further, the image forming apparatus 400 executes a print job for storing, in the HDD 160, code data received from the PCs 501 and 502 via the LAN 500, then converting the code data into image data, and controlling the printer apparatus 100 to print an image based on the image data on a recording sheet.

Figure 3:
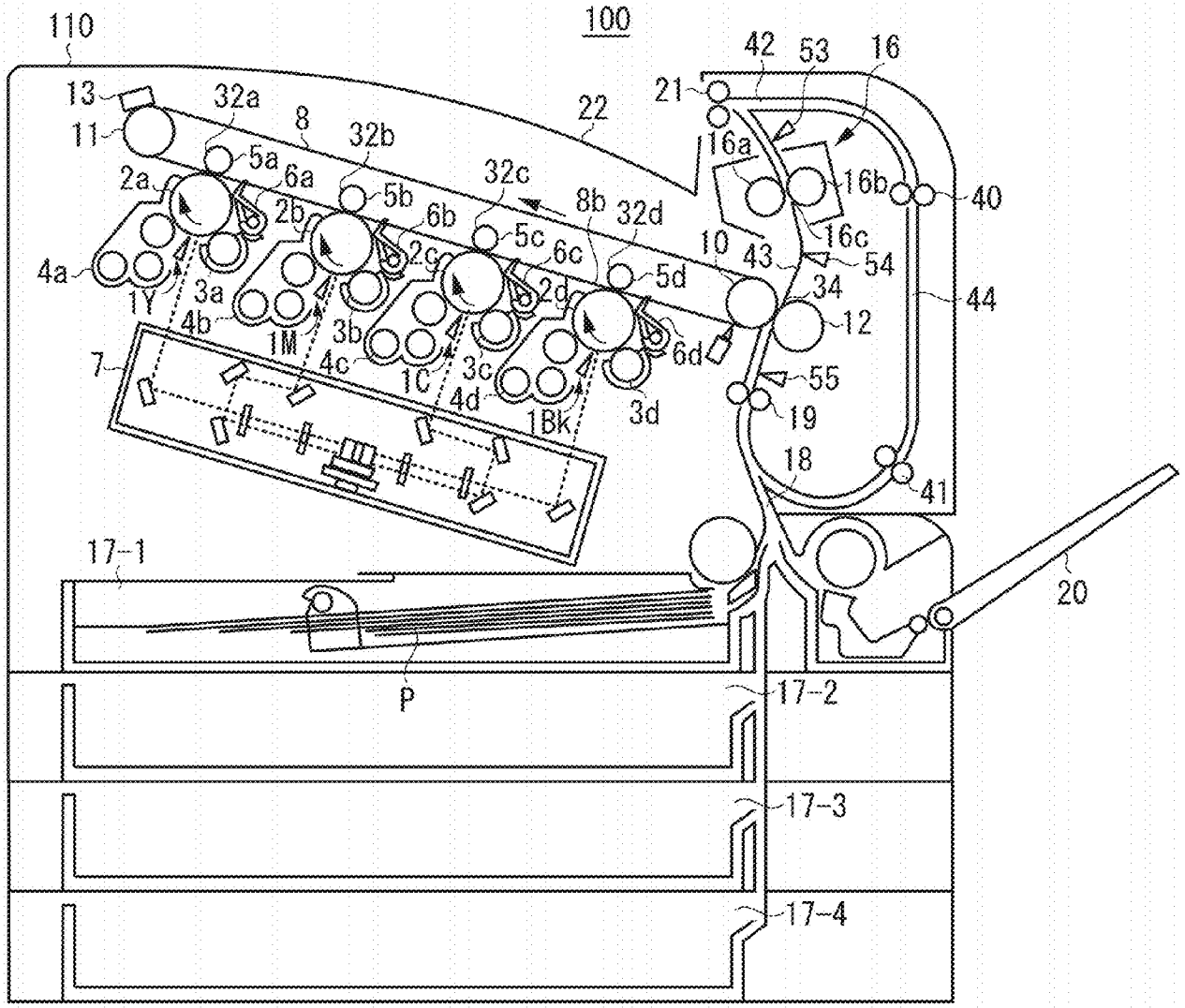
FIG. 3 is a cross-sectional view illustrating a configuration of a printer apparatus illustrated in FIG. 1.
Figure 4:
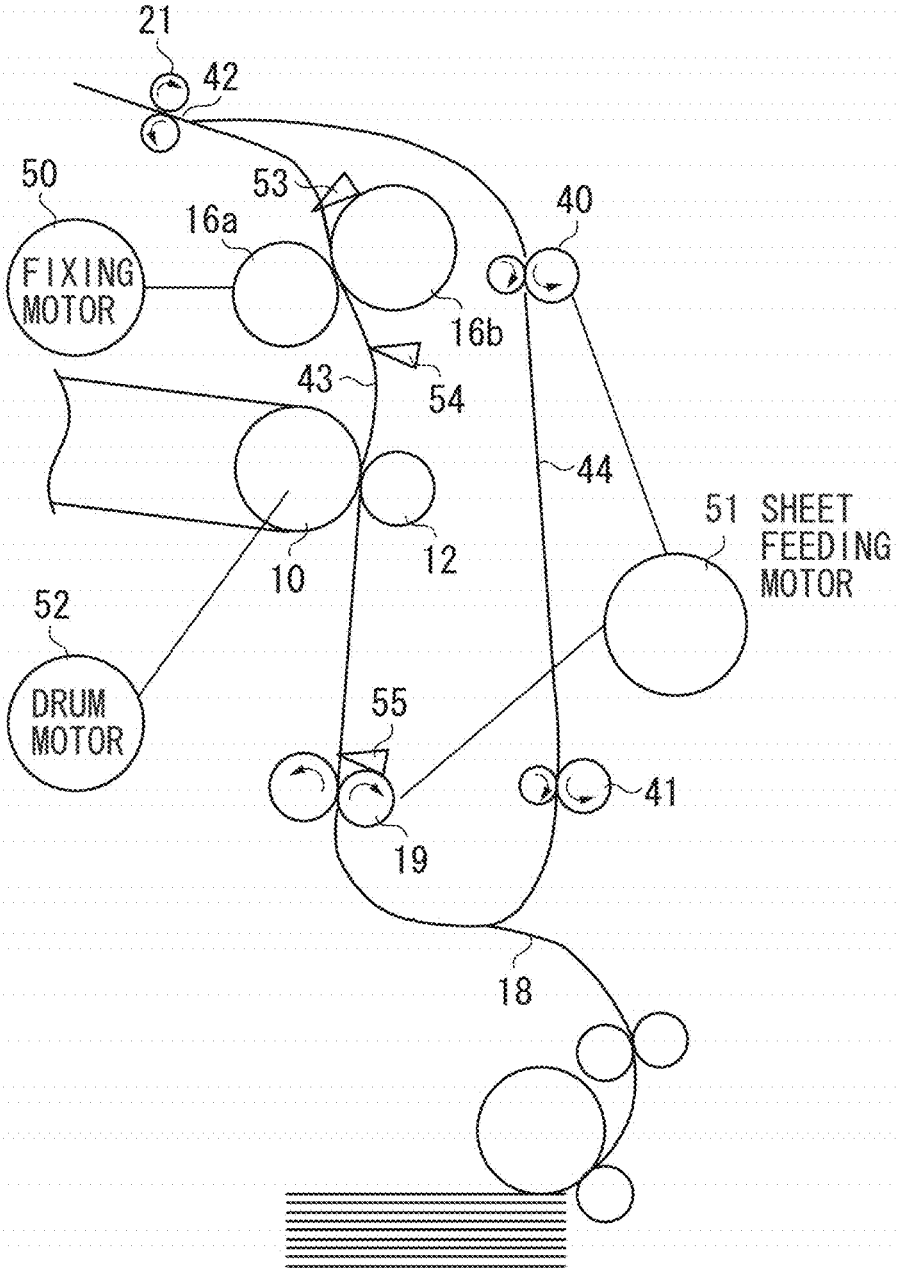
FIG. 4 is a cross-sectional view illustrating a configuration of the printer apparatus illustrated in FIG. 1.

FIGS. 3 and 4 are cross-sectional views illustrating the configuration of the printer apparatus 100 illustrated in FIG. 1. This illustrates an example where sheet feeding cassettes 17-1 to 17-4 are included as units for feeding sheets. Further, the process of setting any one of the sheet feeding cassettes 17-1 to 17-4 as a particular sheet feeding unit (a default sheet feeding unit), and the process of specifying the type of sheet to be stored in the particular sheet feeding unit will be described below. Further, the present exemplary embodiment illustrates an example of processing using the top sheet feeding cassette 17-1 as the particular sheet feeding unit, but is not limited to this.

In FIG. 3, the printer unit 110 is a tandem color printing apparatus using an electrophotographic method, and includes four image forming units 1Y, 1M, 1C, and 1Bk, an intermediate transfer belt 8, and a laser exposure unit 7, which form an image forming section.

The image forming unit 1Y is a unit for forming a yellow toner image. The image forming unit 1M is a unit for forming a magenta toner image. The image forming unit 1C is a unit for forming a cyan toner image. The image forming unit 1Bk is a unit for forming a black toner image. The image forming units 1Y, 1M, 1C, and 1Bk are arranged at regular intervals in line.

In the image forming units 1Y, 1M, 1C, and 1Bk, drum-type electrophotographic photosensitive members (hereinafter referred to as "photosensitive drums") 2*a*, 2*b*, 2*c*, and 2*d* are arranged, respectively. Around the photosensitive drums 2*a*, 2*b*, 2*c*, and 2*d*, primary charging devices 3*a*, 3*b*, 3*c*, and 3*d*, developing devices 4*a*, 4*b*, 4*c*, and 4*d*, transfer rollers 5*a*, 5*b*, 5*c*, and 5*d*, and drum cleaner devices 6*a*, 6*b*, 6*c*, and 6*d* are arranged, respectively.

Each of the photosensitive drums 2*a*, 2*b*, 2*c*, and 2*d* is a negatively-charged organic photoconductor (OPC) photosensitive member, has a photoconductive layer on the aluminum base of the drum, and rotates clockwise as indicated by the arrow in FIG. 3 at a predetermined process speed by a driving device (not illustrated). On each of the photosensitive drums 2*a*, 2*b*, 2*c*, and 2*d*, the laser exposure unit 7 forms an electrostatic latent image of the corresponding color.

The primary charging devices 3*a*, 3*b*, 3*c*, and 3*d* uniformly charge the surfaces of the photosensitive drums 2*a*, 2*b*, 2*c*, and 2*d*, respectively, to a predetermined negative potential by a charging bias applied from a charging bias power source (not illustrated).

The developing devices 4*a*, 4*b*, 4*c*, and 4*d* store yellow toner, cyan toner, magenta toner, and black toner, respectively. The developing devices 4*a*, 4*b*, 4*c*, and 4*d* apply the toners of the colors onto the electrostatic latent images formed on the photosensitive drums 2*a*, 2*b*, 2*c*, and 2*d*, respectively, to develop and visualize the electrostatic latent images as toner images.

The transfer rollers 5*a*, 5*b*, 5*c*, and 5*d* are arranged to be able to contact the photosensitive drums 2*a*, 2*b*, 2*c*, and 2*d* with the intermediate transfer belt 8 therebetween at primary transfer units 32*a*, 32*b*, 32*c*, and 32*d*, respectively. The transfer rollers 5*a*, 5*b*, 5*c*, and 5*d* sequentially transfer the corresponding toner images on the photosensitive drums 2*a*, 2*b*, 2*c*, and 2*d*, respectively, onto the intermediate transfer belt 8 by placing one image on top of another.

The drum cleaner devices 6*a*, 6*b*, 6*c*, and 6*d* scrape off, with cleaning blades, residual toner that has remained on the photosensitive drums 2*a*, 2*b*, 2*c*, and 2*d* at the time of primary transfer, thereby cleaning the surfaces of the photosensitive drums 2*a*, 2*b*, 2*c*, and 2*d*, respectively.

The intermediate transfer belt 8 is arranged to be able to contact the photosensitive drums 2*a*, 2*b*, 2*c*, and 2*d* on the upper surface sides of the photosensitive drums 2*a*, 2*b*, 2*c*, and 2*d* in FIG. 1, and is stretched around a secondary transfer opposing roller 10 and a tension roller 11. Further, a primary transfer surface 8*b* is formed on the surface of the intermediate transfer belt 8 opposed to the photosensitive drums 2*a*, 2*b*, 2*c*, and 2*d*. The primary transfer surface 8*b* is arranged to be inclined so that the secondary transfer opposing roller 10 is located on the lower side. In other words, the primary transfer surface 8*b* of the intermediate transfer belt 8 is arranged to be inclined so that a secondary transfer unit 34 is located on the lower side. This angle of inclination is set, for example, to about 15°. The intermediate transfer belt 8 is formed of a dielectric resin, such as polycarbonate, a polyethylene terephthalate resin film, or a polyvinylidene fluoride resin film.

The secondary transfer opposing roller 10 is a driving roller for driving the intermediate transfer belt 8, and is arranged to be able to contact the secondary transfer roller 12 with the intermediate transfer belt 8 therebetween at the secondary transfer unit 34.

The tension roller 11 is arranged on the opposite side of the secondary transfer opposing roller 10 across the primary transfer units 32*a*, 32*b*, 32*c*, and 32*d*, and gives tension to the intermediate transfer belt 8. Near the tension roller 11 and outside the endless intermediate transfer belt 8, a belt cleaning device 13 is arranged for removing and collecting residual toner remaining on the surface of the intermediate transfer belt 8.

The laser exposure unit 7 is disposed below the image forming units 1Y, 1M, 1C, and 1Bk in FIG. 1. The laser exposure unit 7 includes a laser-emitting unit for emitting light corresponding to a time-series electric digital pixel signal of given image information, polygonal lenses, and reflecting mirrors. The laser exposure unit 7 exposes the photosensitive drums 2*a*, 2*b*, 2*c*, and 2*d*, thereby forming electrostatic latent images according to image information and corresponding to the respective colors on the surfaces of the photosensitive drums 2*a*, 2*b*, 2*c*, and 2*d* charged by the primary charging devices 3*a*, 3*b*, 3*c*, and 3*d*, respectively.

Further, the printer unit 110 includes the sheet feeding cassettes 17-1 to 17-4, a manual feed tray 20, registration rollers 19, a fixing unit 16, discharge/reverse rollers 21, two-sided rollers 40 and 41, a one-sided conveying path 43, and a two-sided conveying path 44.

Figure 10:
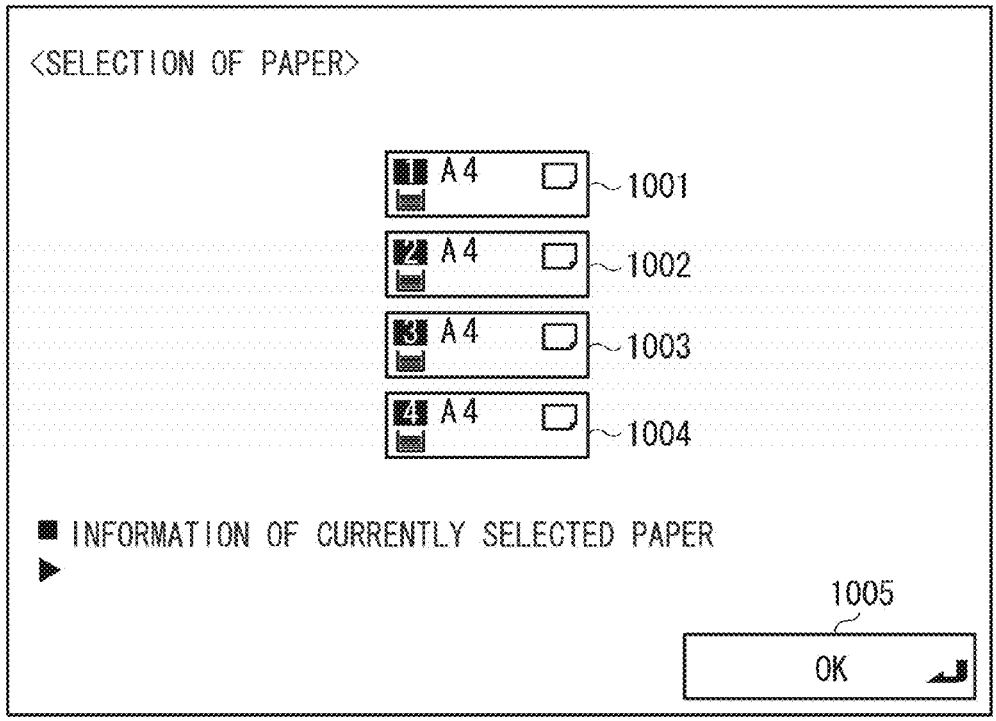
FIG. 10 is a diagram illustrating an example of a UI screen displayed on the operation unit.
Figure 11:
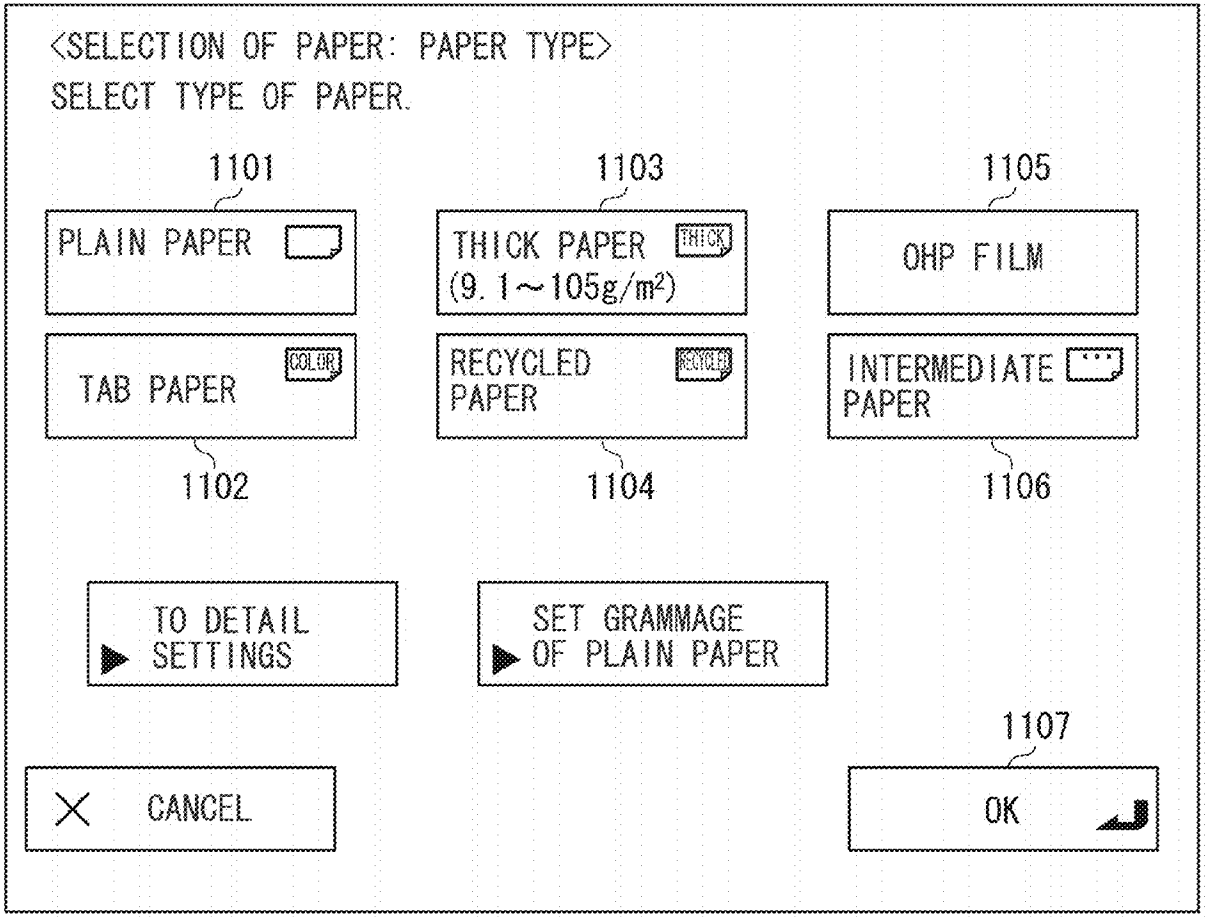
FIG. 11 is a diagram illustrating an example of a UI screen displayed on the operation unit.

In each sheet feeding cassette 17, sheets P of a predetermined size are stored. Further, in the manual feed tray 20, sheets P of a predetermined size are stacked. The sheets P stored in the sheet feeding cassette 17 or the sheets P stacked in the manual feed tray 20 are supplied one by one to the registration rollers 19 through a sheet feeding path 18. The CPU 311 stores and manages, in the HDD 160, information indicating the size and the type of paper held in each of the sheet feeding cassettes 17-1 to 17-4 and the manual feed tray 20. The CPU 311 receives, through a screen displayed on the operation unit 150, information indicating the type of paper stored in each sheet feeding cassette 17, and updates the originally stored information to the newly received information. Specifically, FIGS. 10 and 11 are diagrams illustrating examples of user interface (UI) screens displayed on the operation unit 150. This is an example of a paper type change dialog.

When changing the type of paper set in each sheet feeding cassette, the user presses and selects any one of buttons 1001 to 1004 that corresponds to one of the sheet feeding cassettes 17-1 to 17-4 in which the type of paper is to be changed. If the user has selected any one of the buttons 1001 to 1004 and then pressed an OK button 1005, the screen transitions to a dialog illustrated in FIG. 11.

The example of the UI screen illustrated in FIG. 11 is an example of the dialog for selecting the type of paper. If the user has pressed any one of buttons 1101 to 1106 that represents the type of paper to which the user wishes to change the currently set type of paper, and then pressed an OK button 1107, the selected type of paper is stored in the HDD 160 in association with the sheet feeding cassette. The types of paper illustrated as examples in FIG. 11 are six types. Alternatively, more types of paper may be displayed. In this way, the CPU 311 can recognize what type of paper is held in each of the sheet feeding cassettes 17-1 to 17-4 and the manual feed tray 20. Similarly, as for the size of paper, the size (A4, B5, or A4) received on a size selection screen (not illustrated) for the sheet feeding cassette selected on the screen illustrated in FIG. 10 may be stored in the HDD 160 in association with the selected sheet feeding cassette. Further, each of the sheet feeding cassettes 17-1 to 17-4 may include a size detection sensor for detecting the size of sheet stored in the sheet feeding cassette, so that the CPU 311 recognizes the size of sheet in the sheet feeding cassette based on a signal from the size detection sensor.

The registration rollers 19 correct the skew of the sheet P and feeds the sheet P of which the skew has been corrected to the secondary transfer unit 34 to meet the timing of the image formation at the secondary transfer unit 34.

The fixing unit 16 includes a fixing roller 16*a*, a pressure roller 16*b*, and a fixing nip portion (not illustrated) between the fixing roller 16*a* and the pressure roller 16*b*, and is arranged downstream of the secondary transfer unit 34 in the conveying direction of the sheet P so as to form a vertical path. The fixing roller 16*a* includes a heater such as a ceramic heater for heating the sheet P. The pressure roller 16*b* is pressed against the fixing roller 16*a* by a predetermined pressing force.

The discharge/reverse rollers 21, which function both as a discharge unit and a reverse unit, are arranged downstream of the fixing unit 16 in the conveying direction of the sheet P. The discharge/reverse rollers 21 can rotate forward and backward. The discharge/reverse rollers 21 rotate forward to discharge the sheet P conveyed from the fixing unit 16 onto a sheet discharge tray 22, or rotate backward to convey the sheet P conveyed from the fixing unit 16 to the two-sided rollers 40. The two-sided rollers 40 convey the sheet P conveyed from the discharge/reverse rollers 21 to the two-sided rollers 41. The two-sided rollers 41 convey the sheet P conveyed from the two-sided rollers 40 to the registration rollers 19.

The one-sided conveying path 43 includes a feeding path, which is a path for the sheet P fed from the registration rollers 19 to the secondary transfer unit 34, and a conveying path, which is a path for the sheet P conveyed from the secondary transfer unit 34 to the discharge/reverse rollers 21 through the fixing unit 16. The two-sided conveying path 44 is a path for the sheet P reversed by the discharge/reverse rollers 21, until the sheet P is conveyed to the registration rollers 19 through the two-sided rollers 40 and 41. Further, the end portions of the one-sided conveying path 43 and the two-sided conveying path 44 are connected to form a single circular conveying path. On the one-sided conveying path 43, a sheet discharge sensor 53, which detects the presence or absence of the sheet P remaining on the one-sided conveying path 43, a fixing loop sensor 54, and a registration sensor 55 are arranged.

Further, as illustrated in FIG. 4, the discharge/reverse rollers 21, the fixing roller 16*a*, and the pressure roller 16*b* are connected to a fixing motor 50. The registration rollers 19 and the two-sided rollers 40 and 41 are connected to a sheet feeding motor 51. The secondary transfer opposing roller 10 is connected to a drum motor 52.

The fixing motor 50 causes the discharge/reverse rollers 21, the fixing roller 16*a*, and the pressure roller 16*b* to rotate in a sheet discharge direction to send the sheet P out of the apparatus from the fixing unit 16. Further, the fixing motor 50 drives the discharge/reverse rollers 21 to rotate in a sheet reverse direction to send the sheet P to the two-sided rollers 40 from the discharge/reverse rollers 21.

The sheet feeding motor 51 causes the registration rollers 19 and the two-sided rollers 40 and 41 to rotate in a sheet conveying direction to send the sheet P reversed by the discharge/reverse rollers 21 to the secondary transfer unit 34. The drum motor 52 causes the secondary transfer opposing roller 10 to rotate to send, to the fixing unit 16, the sheet P having fed to the secondary transfer unit 34.

In FIG. 4, the sheet discharge direction is the direction in which the discharge/reverse rollers 21 rotate in the directions indicated by the arrows. The sheet reverse direction is the direction in which the discharge/reverse rollers 21 rotate in the directions opposite to the directions indicated by the arrows. Further, the sheet conveying direction is the direction in which the registration rollers 19 and the two-sided rollers 40 and 41 rotate in the directions indicated by the arrows. The printer unit 110 is configured so that even with the sheet P remaining over the discharge/reverse rollers 21 and the two-sided rollers 40 and 41, the sheet P can be pulled out by the sheet feeding motor 51 allowing the two-sided rollers 40 and 41 to rotate.

Figure 5:
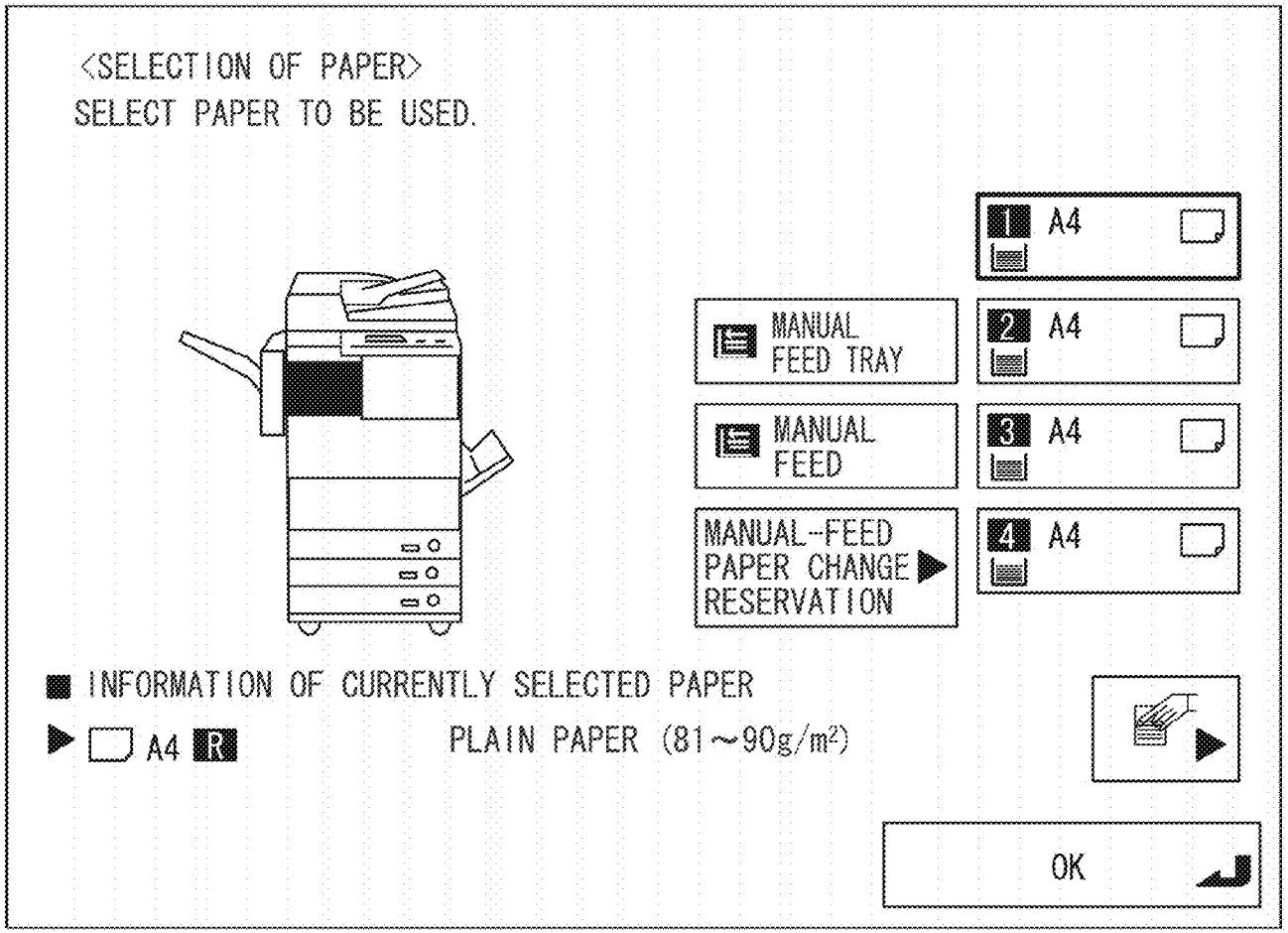
FIG. 5 is a diagram illustrating an example of a UI screen displayed on an operation unit.

FIG. 5 is a diagram illustrating an example of a UI screen displayed on the operation unit 150 illustrated in FIG. 2. Referring to FIG. 5, the process of selecting a default sheet feeding cassette is described below. In the present exemplary embodiment, an example is described where a particular sheet feeding cassette is automatically selected according to the type of job (a copy job in the present exemplary embodiment).

A printing apparatus without a document size detection function in a scanner cannot use an automatic sheet selection function. Therefore, the user needs to select a sheet feeding cassette before the execution of a copy job. It is, however, cumbersome for the user to select a sheet feeding cassette every time a copy job is executed. Thus, in the present exemplary embodiment, a default sheet feeding cassette is set in advance. Then, if the user has not specified a sheet feeding cassette as the sheet feeding source before the execution of a copy job, the default sheet feeding cassette determined in advance is set as the sheet feeding source. Then, sheets are fed from the set sheet feeding cassette, and the printing of the copy job is performed. This can save the user's trouble of specifying a sheet feeding cassette every time a copy job is executed. Further, if the sheet feeding cassette having the shortest sheet conveying path to the secondary transfer opposing roller 10 and the tension roller 11 is selected in advance as the default sheet feeding cassette, it is possible to shorten the time until the completion of the printing. This default sheet feeding cassette is selected as follows. After the user has pressed a user mode key, the screen illustrated in FIG. 5 is displayed in advance on the operation unit 150, so that the user selects the default sheet feeding cassette. In the example illustrated in FIG. 5, the cassette 17-1 is selected. Thus, if the user has pressed an OK button in this state, the sheet feeding cassette 17-1 is set as the default sheet feeding cassette. Then, the sheet feeding cassette set in advance as the default sheet feeding cassette is saved in the RAM 312 and referenced by the CPU 311. For example, at the start of the image forming apparatus 400 or if having received the pressing of a reset key included in the operation unit 150, the CPU 311 reads the default sheet feeding cassette saved in the RAM 312, and sets the read default sheet feeding cassette as the sheet feeding source.

If, however, a special type of paper such as thick paper is stored in the sheet feeding cassette set as the default sheet feeding cassette, there are limitations on the functions that can be used by the user. For example, if thick paper is stored in the default sheet feeding cassette and the user has specified two-sided printing as a setting for a copy job, the thick paper cannot pass through the two-sided conveying path. Therefore, it is not possible to perform two-sided printing. Further, if thick paper is stored in the default sheet feeding cassette and the user has specified stapling as a setting for a copy job, the thick paper cannot be stapled. Therefore, every time two-sided printing or stapling is performed, the user needs to specify a sheet feeding cassette different from the sheet feeding cassette set as the default sheet feeding cassette. Thus, it is burdensome for the user to specify a sheet feeding cassette.

Further, if paper used for a particular purpose such as preprint paper or an envelope is set in the default sheet feeding cassette and the user has executed a copy job without being aware of the setting, the special paper may be used against the intention of the user. Moreover, if the sheet feeding cassette selected as the default sheet feeding cassette has become unable to be used due to paper out or a failure, the user eventually needs to select another sheet feeding cassette every time a copy job is executed, which is cumbersome. A method for solving these problems is described below.

Figure 6A:
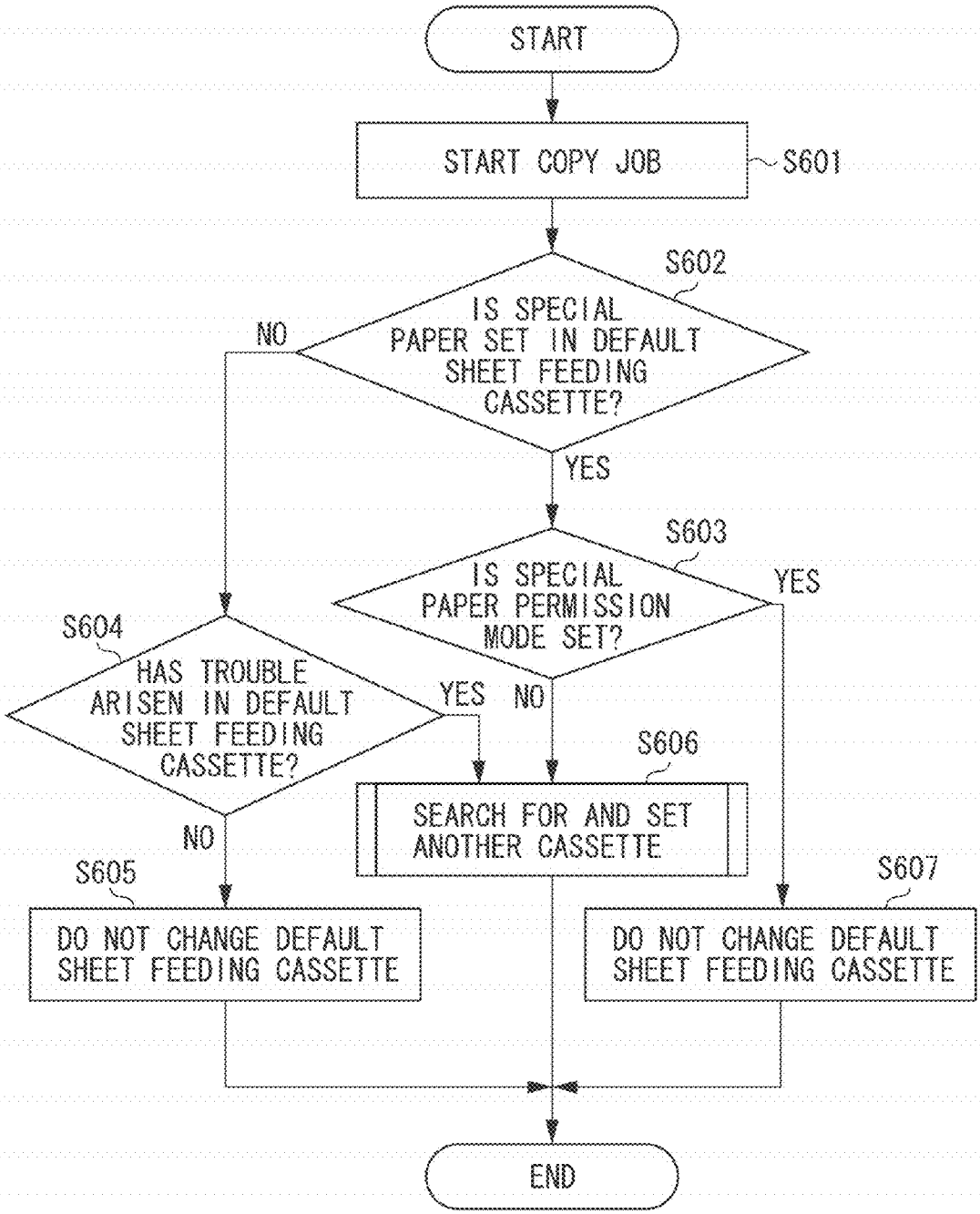

FIGS. 6A and 6B are a flow chart illustrating a method for controlling a printing apparatus according to the present exemplary embodiment and a table to be referenced. This is an example where the default sheet feeding cassette is changed according to the conditions when a copy job is executed. A program corresponding to each step is controlled by the CPU 311 of the controller unit 300 sequentially loading programs stored in the ROM 313 or the HDD 160 into the RAM 312 and executing the programs. A description is given below of control in which the default sheet feeding cassette is changed according to the conditions when a copy job is executed. The flow chart is illustrated in FIG. 6A, and the table to be referenced is illustrated in FIG. 6B. A description is given below of control in which if a job using a particular sheet feeding unit has been requested, it is determined whether or not the type of sheet stored in the particular sheet feeding unit is a particular type of sheet, and the particular sheet feeding unit is changed to another one of the plurality of sheet feeding units according to the determination. The type of job is the job type specified by the user.

First, in step S601, the CPU 311 starts a copy job. More specifically, the CPU 311 instructs the reader apparatus 200 to read a document. The reader apparatus 200 conveys documents, set on an automatic document feeder (ADF) provided in the reader apparatus 200, one by one and reads the conveyed document. If there is no document on the automatic document feeder and a document is set on a document platen, the reader apparatus 200 moves an optical scanning unit to scan the document placed on the document platen.

Next, in step S602, the CPU 311 determines whether special paper is set in the sheet feeding cassette (for example, the sheet feeding cassette 17-1) currently set as the default sheet feeding cassette. The determination in step S602 is made by the CPU 311 reading the type of paper set in the current default sheet feeding cassette and stored in the HDD 160, and comparing the read type of paper with a special paper list illustrated in FIG. 6B. The special paper is paper with some kind of limitations being placed on the functions of the image forming apparatus 400.

As illustrated in FIG. 6B, examples of the special paper according to the present exemplary embodiment include thick paper, a film sheet, an envelope, a preprint sheet, a tab sheet, and a translucent sheet. The translucent sheet corresponds to a sheet termed intermediate paper. The description is given taking an overhead projector (OHP) film as an example of the film sheet.

If, as a result of the determination in step S602, the CPU 311 has determined that special paper is not set in the sheet feeding cassette currently set as the default sheet feeding cassette (NO in step S602), the processing proceeds to step S604. Next, in step S604, the CPU 311 checks whether a trouble has arisen in the currently selected default sheet feeding cassette. The trouble refers to the state where a sheet cannot be normally fed for a reason such as paper out or a failure. If, as a result of the determination in step S604, the CPU 311 has determined that a trouble has not arisen (NO in step S604), the processing proceeds to step S605.

In step S605, the CPU 311 does not perform the process of changing the default sheet feeding cassette, and ends this processing. Thus, in the processes of step S605 and thereafter, the sheet feeding cassette (the sheet feeding cassette 17-1) currently set as the default sheet feeding cassette is used as it is as the sheet feeding source for the printing of the copy job. In other words, the CPU 311 controls the printer unit 100 to feed a sheet from the sheet feeding cassette set as the default sheet feeding cassette, and to print an image on the sheet. After the execution of the copy job has been completed, the CPU 311 ends this processing.

If, on the other hand, as a result of the determination in step S604, the CPU 311 has determined that a trouble has arisen (YES in step S604), the processing proceeds to a subroutine of step S606, and the CPU 311 performs the process of changing the default sheet feeding cassette. Then, the CPU 311 executes the copy job using as the sheet feeding source the sheet feeding cassette set after the change process. In other words, the CPU 311 controls the printer unit 100 to feed a sheet from the sheet feeding cassette set after the change in the process of step S606, and print an image on the sheet. After the execution of the copy job has been completed, the CPU 311 ends this processing. The details of the subroutine of step S606 will be described below with reference to FIG. 9.

A description is given of the processing performed when, on the other hand, as a result of the determination in step S602, the CPU 311 has determined that special paper is set.

If the CPU 311 has determined that special paper is set (YES in step S602), the processing proceeds to step S603. In step S603, the CPU 311 determines whether a special paper permission mode is set in advance. The special paper permission mode is a mode used by a user who wishes to set special paper in the default sheet feeding cassette (the sheet feeding cassette 17-1).

Figure 7:
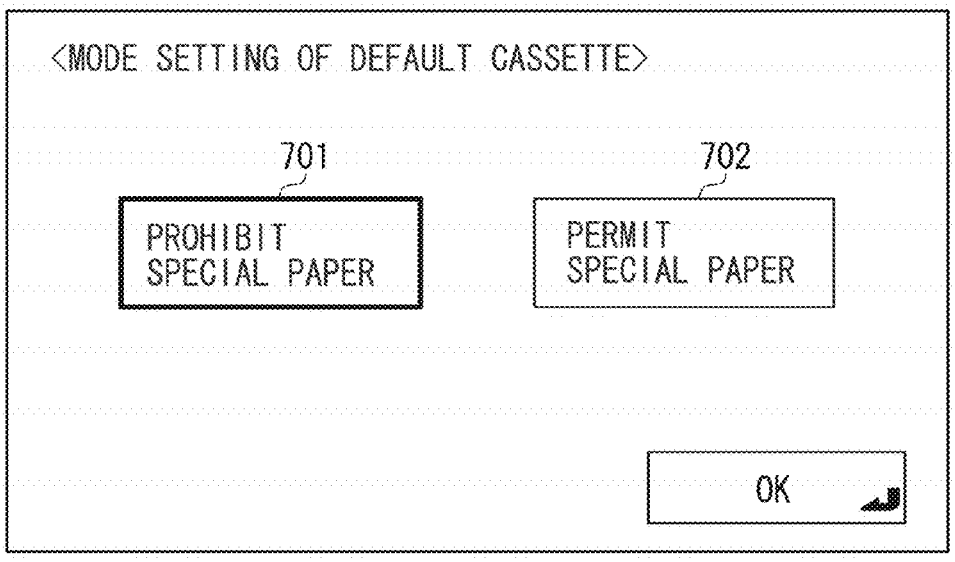
FIG. 7 is a diagram illustrating an example of a UI screen displayed on the operation unit.

The special paper permission mode is set using a UI screen illustrated in FIG. 7, which is displayed by pressing a special paper permission mode setting button.

The screen illustrated in FIG. 7 is a screen displayed when a special paper permission mode setting button included in the operation unit 150 has been pressed. In FIG. 7, to prohibit the setting of special paper in the default sheet feeding cassette and the start of the printing, the user presses a button 701 and then presses an OK button with the button 701 selected. On the other hand, to permit the setting of special paper in the default sheet feeding cassette and the start of the printing, the user presses a button 702 and then presses the OK button with the button 702 selected. The content of the setting made using the button 701 or the button 702 is stored in the HDD 160 and appropriately referenced by the CPU 311. An example has been given where the special paper permission mode is set in advance before the processing illustrated in FIG. 6A is performed. Alternatively, the user may set the special paper permission mode according to the determination in step S602 that special paper is set in the default sheet feeding cassette.

Figure 8:
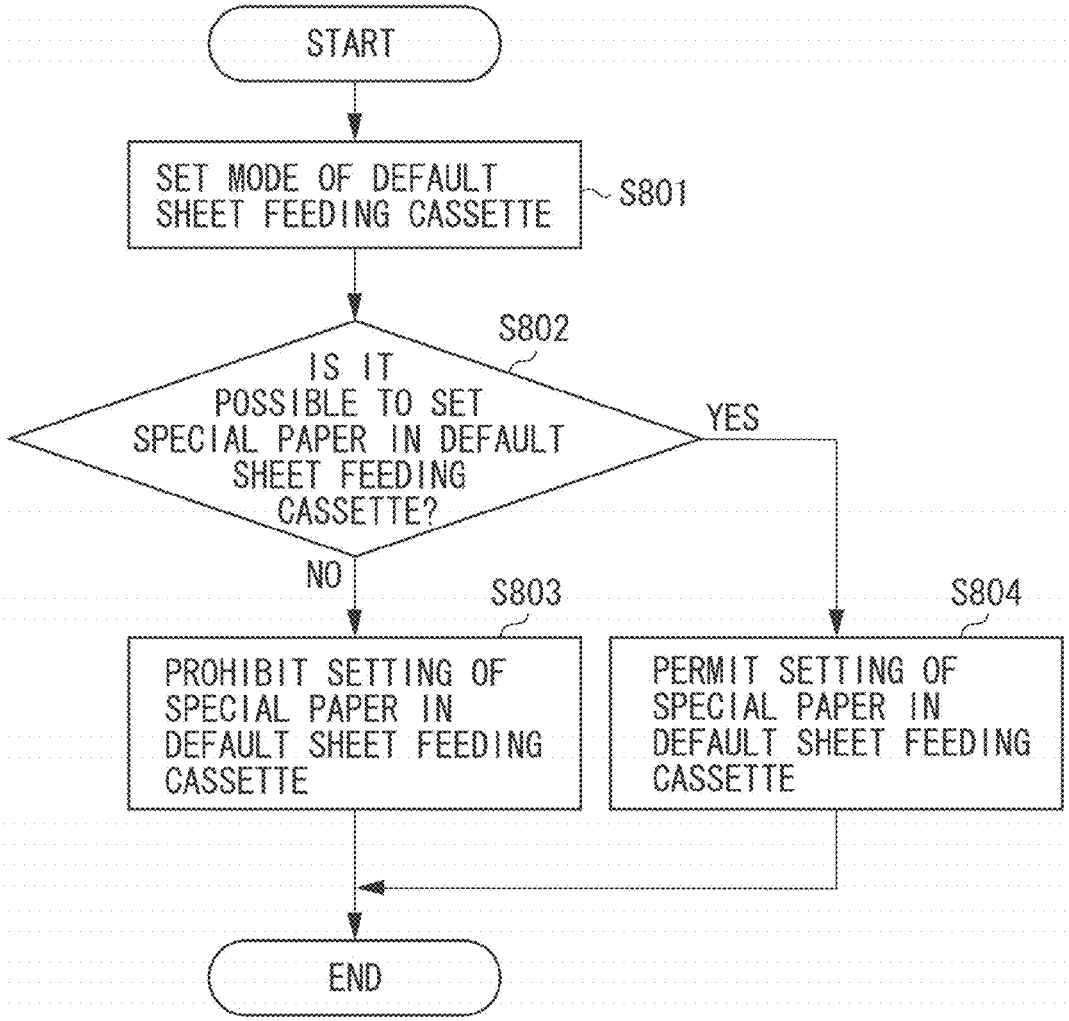
FIG. 8 is a flow chart illustrating the method for controlling a printing apparatus.

FIG. 8 is a flow chart illustrating the method for controlling a printing apparatus according to the present exemplary embodiment. This is an example of a special paper permission mode setting process. A program corresponding to each step is controlled by the CPU 311 of the controller unit 300 sequentially loading programs stored in the ROM 313 or the HDD 160 into the RAM 312 and executing the programs.

First, in step S801, if the user has pressed the special paper permission mode setting button included in the operation unit 150, the CPU 311 starts setting the special paper permission mode of the default sheet feeding cassette. Upon starting the setting, the CPU 311 displays the dialog illustrated in FIG. 7 on the operation unit 150. In step S802, the CPU 311 waits for the user to select either mode. If the CPU 311 has determined that the user has pressed the button 701 (NO in step S802), the processing proceeds to step S803. In step S803, the CPU 311 stores information indicating that the setting of special paper in the default sheet feeding cassette and the start of the printing are prohibited, in the HDD 160.

On the other hand, if the CPU 311 has determined that the user has selected the button 702 (YES in step S802), the processing proceeds to step S804. In step S804, the CPU 311 stores, in the HDD 160, information indicating that the setting of special paper in the default sheet feeding cassette and the start of the printing are permitted.

In this way, the on/off state of the special paper permission mode is thus set.

Referring back to FIG. 6A, next, if the CPU 311 has determined in step S603 that the setting of special paper is not permitted (NO in step S603), the processing proceeds to the subroutine of step S606. The details of the subroutine of step S606 will be described with reference to FIG. 9.

If the CPU 311 has determined in step S603 that the setting of special paper is permitted (YES in step S603), the processing proceeds to step S607. In step S607, the CPU 311 does not change the default sheet feeding cassette, and executes the copy job using the default sheet feeding cassette as the sheet feeding source for the copy job. In other words, the CPU 311 controls the printer unit 100 to feed a sheet from the sheet feeding cassette set as the default sheet feeding cassette, and to print an image on the sheet. After the execution of the copy job has been completed, the CPU 311 ends this processing. Consequently, the sheet feeding cassette currently selected as the default sheet feeding cassette is used.

Figure 9:
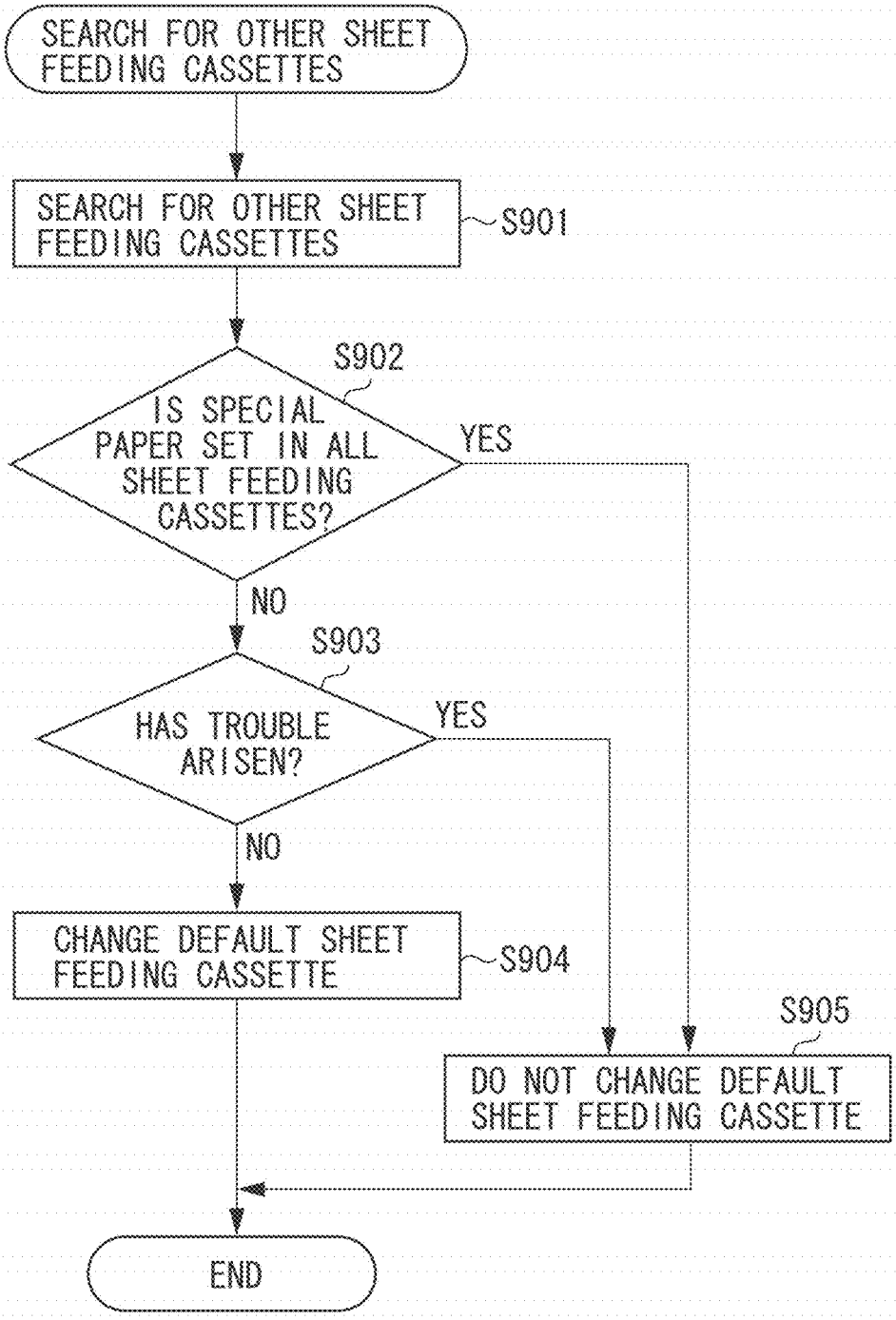
FIG. 9 is a flow chart illustrating a method for controlling a printing apparatus.

FIG. 9 is a flow chart illustrating the method for controlling a printing apparatus according to the present exemplary embodiment. This example corresponds to the detailed flow of the process of searching for and setting another cassette, which is illustrated in step S606 in FIG. 6. A program corresponding to each step is controlled by the CPU 311 of the controller unit 300 sequentially loading programs stored in the ROM 313 or the HDD 160 into the RAM 312 and executing the programs. In the present exemplary embodiment, the sheet feeding source is selected as the default sheet feeding cassette (a sheet feeding cassette for storing a particular sheet) by giving priority to the sheet feeding cassette having the shortest length of a conveying path for conveying a sheet to the image forming section.

First, in step S901, the CPU 311 searches for sheet feeding cassettes that are present in the system but are not selected as the default sheet feeding cassette. In an example of the present exemplary embodiment, the sheet feeding cassettes 17-2 to 17-4 are found. Next, in step S902, the CPU 311 determines whether special paper is set in all the sheet feeding cassettes found by the search performed in step S901. At this time, the determination of whether special paper is set is made by reading the type of paper set in each sheet feeding cassette from the HDD 160, and comparing the read type of paper with the special paper list illustrated in FIG. 6B.

If, as a result of the determination in step S902, the CPU 311 has determined that special paper is set in all the sheet feeding cassettes (YES in step S902), the processing proceeds to step S905.

In step S905, the CPU 311 does not change the default sheet feeding cassette, and ends the subroutine of step S606.

On the other hand, as a result of the determination in step S902, if the CPU 311 has determined that sheet feeding cassettes have been found in which special paper is not set (NO in step S902), the processing proceeds to step S903.

In step S903, the CPU 311 determines whether a trouble has arisen in each of the sheet feeding cassettes found in step S902. The method for determining a trouble is similar to that in step S604, and therefore is not described here. Specifically, the CPU 311 determines whether there is any sheet feeding cassette in which a trouble has not arisen. As a result of the determination in step S903, if the CPU 311 has determined that a trouble has arisen in all the cassettes (YES in step S903), the processing proceeds to step S905.

If, on the other hand, as a result of the determination in step S903, the CPU 311 has determined that sheet feeding cassettes have been found in which a trouble has not arisen (NO in step S903), the processing proceeds to step S904. In step S904, the CPU 311 selects, from among the sheet feeding cassettes found as a result of the determinations in steps S902 and S903, the sheet feeding cassette having the shortest sheet conveying path to the secondary transfer opposing roller 10 and the tension roller 11 as the default sheet feeding cassette. Then, the CPU 311 saves, in the HDD 160, information indicating that the selected sheet feeding cassette is the default sheet feeding cassette, and the CPU 311 ends this processing. This is the end of the description, with reference to FIGS. 6A to 9, of the method for changing the default sheet feeding cassette according to the conditions when a copy job is executed.

In a second exemplary embodiment, a description is given of a method for, if special paper is stored in the sheet feeding cassette set as the default sheet feeding cassette, requesting the user to change the type of paper set in the sheet feeding cassette. The configuration of the image forming apparatus 400 is similar to that according to the first exemplary embodiment, and therefore is not described in detail here.

As described above, FIGS. 10 and 11 are diagrams illustrating examples of the UI screens displayed on the operation unit 150 illustrated in FIG. 2.

Figure 12:
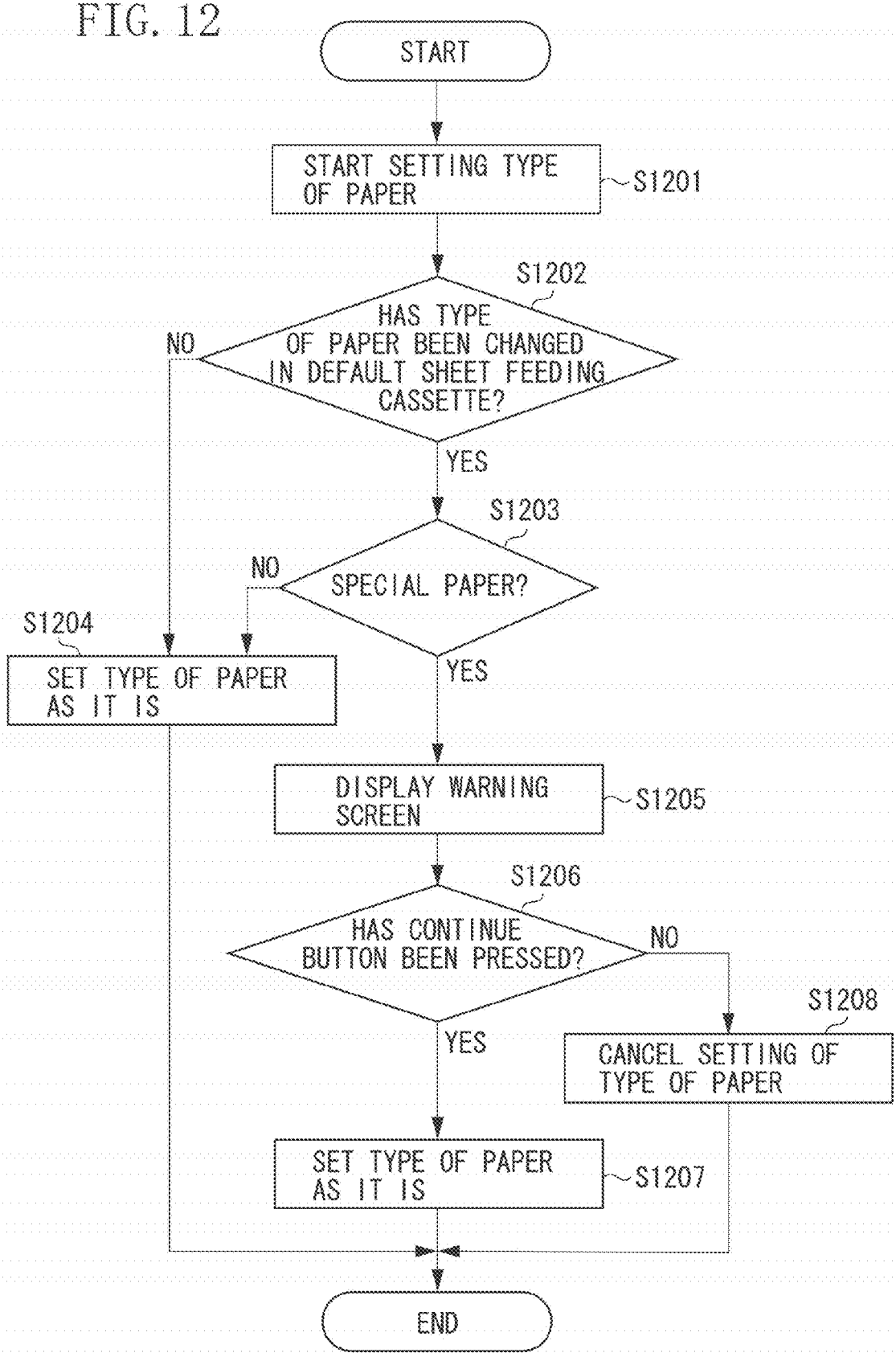
FIG. 12 is a flow chart illustrating a method for controlling a printing apparatus.

FIG. 12 is a flow chart illustrating a method for controlling a printing apparatus according to the present exemplary embodiment. This is an example of a process of changing the type of paper set in a sheet feeding cassette. A program corresponding to each step is controlled by the CPU 311 of the controller unit 300 sequentially loading programs stored in the ROM 313 or the HDD 160 into the RAM 312 and executing the programs. An example is described below in which, according to the determination that the type of sheet to be set in a particular sheet feeding unit is a particular sheet, the type of sheet to be set is displayed on a display unit to give warning, thereby confirming whether it is allowed to determine the type of sheet.

First, in step S1201, the CPU 311 displays the screen illustrated in FIG. 10, and starts the process of setting the type of paper. If the user has selected any one of the sheet feeding cassettes 17-1 to 17-4 on the screen illustrated in FIG. 10, and then has pressed the OK button 1005, the CPU 311 displays the screen illustrated in FIG. 11. The user changes, on the screen illustrated in FIG. 11, the type of paper stored in the sheet feeding cassette selected on the screen illustrated in FIG. 10. Next, in step S1202, the CPU 311 determines whether the type of paper has been changed in the sheet feeding cassette registered in advance as the default sheet feeding cassette among the sheet feeding cassettes 17-1 to 17-4. The determination in step S1202 is made at the timing of the pressing of the OK button 1107 on the screen illustrated in FIG. 11. More specifically, the CPU 311 determines whether the sheet feeding cassette registered as the default sheet feeding cassette in the HDD 160 is the same as the sheet feeding cassette for which the request to change the type of paper has been received on the screen illustrated in FIG. 11. If the CPU 311 has determined that the sheet feeding cassettes are not the same (NO in step S1202), the processing proceeds to step S1204.

In step S1204, the CPU 311 stores, in the HDD 160, information indicating that the type of paper stored in the sheet feeding cassette selected on the screen illustrated in FIG. 10 is the type of paper selected on the screen illustrated in FIG. 11. Then, the CPU 311 ends this processing.

On the other hand, if, as a result of the determination in step S1202, the CPU 311 has determined that the type of paper has been changed in the sheet feeding cassette registered in advance as the default sheet feeding cassette (YES in step S1202), the processing proceeds to step S1203.

In step S1203, the CPU 311 determines whether the type of paper selected on the screen illustrated in FIG. 11 is special paper. The determination in step S1203 is made by comparing the type of paper selected by the user on the UI screen illustrated in FIG. 11 with the special paper list illustrated in FIG. 6B. As a result of the determination in step S1203, if the CPU 311 has determined that the selected type of paper is not special paper (NO in step S1203), the processing proceeds to step S1204. As a result of the determination in step S1203, if the CPU 311 has determined that the selected type of paper is special paper (YES in step S1203), the processing proceeds to step S1205.

Figure 13:
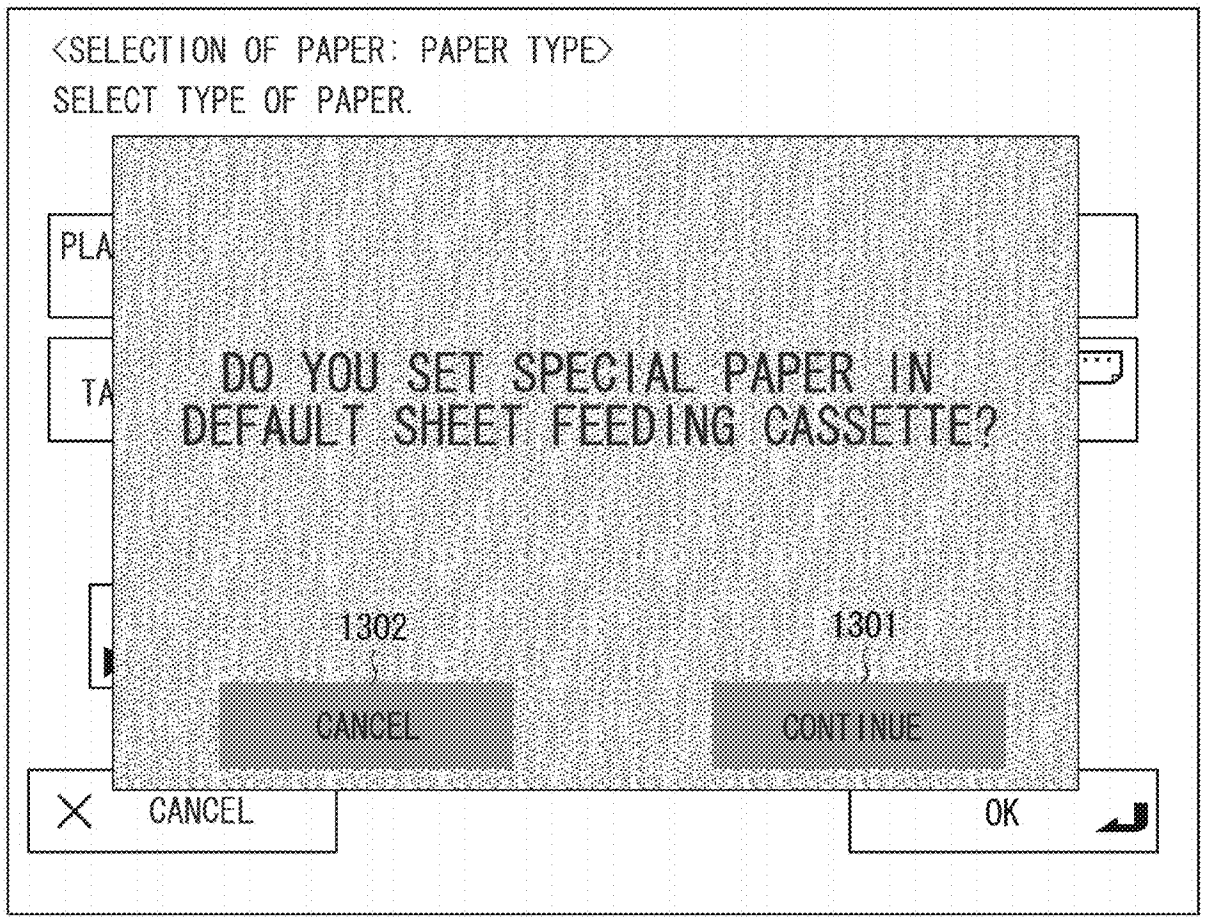
FIG. 13 is a diagram illustrating an example of a UI screen displayed on the operation unit.

In step S1205, the CPU 311 displays on the operation unit 150 a screen illustrated in FIG. 13 (corresponding to a warning dialog). This is a screen for confirming with the user whether it is allowed to set special sheet in the sheet feeding cassette registered as the default sheet feeding cassette. Next, in step S1206, the CPU 311 determines whether the user has pressed a continue button 1301 to give an instruction in response to the warning dialog on the screen illustrated in FIG. 13. The determination in step S1206 is made based on whether the user has pressed a cancel button 1302 or the continue button 1301.

If the CPU 311 has determined that the user has pressed the continue button 1301 (YES in step S1206), the processing proceeds to step S1207. In step S1207, the CPU 311 stores, in the HDD 160, information indicating that the special paper selected on the screen illustrated in FIG. 11 is stored in the sheet feeding cassette registered in advance as the default sheet feeding cassette, and the CPU 311 ends this processing.

On the other hand, if the CPU 311 has determined that the user has pressed the cancel button 1302 (NO in step S1206), the processing proceeds to step S1208. In step S1208, the CPU 311 does not set the type of paper, and cancels the setting of the type of paper. In this case, the CPU 311 does not store information indicating that the special paper selected on the screen illustrated in FIG. 11 is stored, in association with the sheet feeding cassette registered in advance as the default sheet feeding cassette. This results in maintaining the previously stored information of the type of paper set in the sheet feeding cassette registered in advance as the default sheet feeding cassette. The CPU 311 ends this processing.

The present disclosure has been described based on specific exemplary embodiments, but is not limited to the above-described exemplary embodiments.

For example, in the above-described exemplary embodiments, an example has been described in which, after the start of a copy job, it is determined whether special paper is stored in the default sheet feeding cassette. Alternatively, for example, when the default sheet feeding cassette is set before the start of a copy job, it may be determined whether special paper is registered in the sheet feeding cassette requested to be the default sheet feeding cassette by the user. Then, if it has been determined that special paper is registered, warning may be given. In this case, the user may be requested to select another sheet feeding cassette in which special paper is not stored, as the default sheet feeding cassette. On the other hand, if it has been determined that a type of paper other than special paper is registered in the sheet feeding cassette requested to be the default sheet feeding cassette by the user, the requested sheet feeding cassette may be set as the default sheet feeding cassette.

In the above-described exemplary embodiments, an example has been described in which the image forming apparatus 400 receives a change in the type of paper through the operation unit 150. Alternatively, the image forming apparatus 400 may receive a change in the type of paper through the PC 501 or PC 502 outside the image forming apparatus 400.

In this case, the image forming apparatus 400 may cause the above-described screens to be displayed on a display unit included in the PC 501 or PC 502, and receive an instruction from the user through an operation unit included in the PC 501 or 502.

Additional embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-109649 filed May 24, 2013, which is hereby incorporated by reference herein in its entirety.

What is claimed is:

1. A printing apparatus configured to feed a sheet from any one of a plurality of sheet storage units, the printing apparatus comprising:

a setting unit configured to set a sheet storage unit included in the plurality of sheet storage units as a particular sheet storage unit to be used when a sheet storage unit to be used for a job has not been specified;

a specifying unit configured to specify a type of sheet to be stored in a sheet storage unit included in the plurality of sheet storage units; and a control unit configured to perform control so that the specifying unit does not specify a particular type in the sheet storage unit set by the setting unit.

2. The printing apparatus according to claim 1, further comprising a determining unit configured to determine whether the type of sheet specified by the specifying unit is the particular type, wherein, if the determining unit determines that the type of sheet specified by the specifying unit is the particular type, the control unit performs control to change the particular sheet storage unit to another one of the plurality of sheet storage units.

3. The printing apparatus according to claim 2, wherein, if a request to execute a job that uses the sheet storage unit set by the setting unit has been received, the determining unit determines whether the type of sheet specified by the specifying unit is the particular type.

4. The printing apparatus according to claim 2, wherein, if the determining unit determines that the type of sheet specified by the specifying unit is the particular type, the control unit causes a display unit to display a screen for changing the particular sheet storage unit to another one of the plurality of sheet storage units.

5. The printing apparatus according to claim 1, further comprising a judging unit configured to judge whether the specifying unit has specified the particular type in the sheet storage unit set by the setting unit, wherein, if the judging unit judges that the specifying unit has specified the particular type in the sheet storage unit set by the setting unit, the control unit performs control to specify another type in the sheet storage unit set by the setting unit.

6. The printing apparatus according to claim 5, wherein, if the judging unit judges that the specifying unit has specified the particular type in the sheet storage unit set by the setting unit, the control unit causes a display unit to display a screen for specifying another type in the sheet storage unit set by the setting unit.

7. The printing apparatus according to claim 1, further comprising a permitting unit configured to permit the particular type to be specified in the particular sheet storage unit, wherein, if the permitting unit permits the particular type to be specified in the particular sheet storage unit, the control unit permits the specifying unit to specify the particular type in the sheet storage unit set by the setting unit.

8. The printing apparatus according to claim 1, wherein a type of sheet that can be specified by the specifying unit in the sheet storage unit set by the setting unit is limited.

9. The printing apparatus according to claim 1, further comprising a selecting unit configured to, based on information of a job to be executed, automatically select the particular sheet storage unit as a sheet storage unit to be used for the job.

10. The printing apparatus according to claim 9, wherein the selecting unit selects, from among the plurality of storage units, the sheet storage unit having the shortest length of a conveying path for conveying a sheet to an image forming section.

11. The printing apparatus according to claim 1, wherein the particular type includes thick paper, a film sheet, an envelope, a preprint sheet, a tab sheet, or a translucent sheet.

12. A control method for controlling a printing apparatus configured to feed a sheet from any one of a plurality of sheet storage units, the control method comprising:

setting a sheet storage unit included in the plurality of sheet storage units as a particular sheet storage unit to be used when a sheet storage unit to be used for a job has not been specified;

specifying a type of sheet to be stored in a sheet storage unit included in the plurality of sheet storage units; and performing control so that a particular type is not specified in the sheet storage unit set by the setting unit.

13. A non-transitory computer readable storage medium storing computer executable instructions for controlling a printing apparatus configured to feed a sheet from any one of a plurality of sheet storage units, the computer executable instructions comprising:

setting a sheet storage unit included in the plurality of sheet storage units as a particular sheet storage unit to be used when a sheet storage unit to be used for a job has not been specified;

specifying a type of sheet to be stored in a sheet storage unit included in the plurality of sheet storage units; and performing control so that a particular type is not specified in the sheet storage unit set by the setting unit.

* * * * *